United States Patent [19]

Kono

[11] Patent Number: 5,032,723

[45] Date of Patent: Jul. 16, 1991

[54] CHARGED PARTICLE ENERGY ANALYZER

[75] Inventor: Shozo Kono, Sendai, Japan

[73] Assignee: Tosoh Corporation, Shinnanyo, Japan

[21] Appl. No.: 496,688

[22] Filed: Mar. 21, 1990

[30] Foreign Application Priority Data

Mar. 24, 1989 [JP] Japan ..... 1-70472

[51] Int. Cl.[5] ..... H01J 49/48

[52] U.S. Cl. ..... 250/305; 250/304

[58] Field of Search ..... 250/305, 309

[56] References Cited

U.S. PATENT DOCUMENTS 3,783,280 1/1974 Watson ..... 250/305

OTHER PUBLICATIONS

Feller-Feldegg et al., Journal of Electron Spectroscopy and Related Phenomena, 5 (1974) pp. 643-689.

Nuclear Instruments and Methods 172 (1980) 327-336, "An Ellipsoidal Mirror Display Analyzer System for Electron Energy and Angular Measurements", D. E. Eastman et al.

Rev. Scl. Instrum. 52(8), Aug. 1981, pp. 1161-1173 "Novel Charged Particle Analyzer for Momentum Determination in the Multichanneling Mode, II Physical Realization, Performance Tests, and Sample Spectra", H. A. Engelhardt et al.

Rev. Scl. Instrum. 52(6), Jun. 1981, pp. 835-839, "Novel Charged Particle Analyzer for Momentum Determination in the Multichanneling Mode: I. Design Aspects and Electron/Ion Optical Properties", H. A. Engelhardt et al.

J. Phys. E: Sci. Instrum., vol. 13, 1980, printed in Great Britian, "Position-Sensitive Detector System for Angle-Resolved Electron Spectroscopy with a Cylindrical Mirror Analyser", H. A. Van Hoof et al.

*Primary Examiner*—Jack I. Berman

*Attorney, Agent, or Firm*—Oblon, Spivak, McClelland, Maier & Neustadt

[57] ABSTRACT

A charged particle energy analyzer of an electrostatic concentric spherical surface type or a coaxial cylindrical mirror type analyzes the kinetic energy of charged particles emitted or scattered from a sample by irradiating an X-ray or particles to the sample. The energy analyzer comprises the sample and an outlet aperture arranged on the symmetric central axis passing through an electrostatic concentric spherical surface body or a coaxial cylindrical mirror body, an inlet port and an outlet port each having a circular-arc-like slit which has its center on the symmetric central axis, electrodes disposed at the slit of the inlet port to deflect the track of the charged particles and change the speed of the charged particles, and a position sensitive type detector disposed at the rear of the outlet aperture to detect the charged particles.

3 Claims, 5 Drawing Sheets

CHARGED PARTICLE ENERGY ANALYZER

The present invention relates to an analyzer for analyzing the energy of charged particles wherein the angular distribution of charged particles emitted radially at an angle of emission from a point on a sample is measured at one time.

A spectroscopic analyzing method for analyzing the energy of charged particles, especially electrons or ions has been utilized widely by engineers and scientists in the field of technologies of solid surface, interface, thin film, catalyst and so on. Electron spectroscopy is widely known by researchers and engineers of this field through analyzing devices utilizing XPS (X-ray Photoelectron Spectroscopy) or UPS (Ultraviolet Photoelectron Spectroscopy). With regard to ion spectroscopy, there is generally known ISS, (Ion Scattering spectroscopy), RBS (Rutherford Back Scattering) and so on.

As the technologies related to the electron spectroscopy and the ion spectroscopy are sophisticated, a demand of determining not only the magnitude of the energy but also the direction of propagation (angle) has been increased. For this demand, an angle-resolved electron spectroscopic method and an angle-resolved ion spectroscopic method were proposed. In a typical angle-resolved spectroscopic method, an exciting source (light, electrons, ions or the like) is applied to a small region on a sample so that the energy of the emitted or scattered charged particles directing in a specified direction is analyzed. In this case, when a change of detection angle is required, either the sample is rotated or an energy analyzer is rotated with respect to the sample. Accordingly, in the conventional methods it took much time to conduct measurements for obtaining the angle dependence in the analysis of the energy of charged particles.

In order to overcome such difficulty in the angle-resolved spectroscopic method for analyzing the energy of charged particles, there have been proposed angle-and-energy simultaneously measuring type electron energy analyzers wherein the magnitude of the energy and the angle of the charged particles emitted within a specified angular range are simultaneously analyzed. In classifying these analyzers depending on the determination of the specified angle when an angle-and-energy simultaneously measuring method is carried out, there are three types of measuring methods as shown in FIG. 2.

In the type 1, the energy of charged particles emitted within a range of a solid angle of $\Omega$ is analyzed at one time. In the type 2, the energy of charged particles emitted within a range of polar angle at a specified azimuth $\phi$ is analyzed. In the type 3, the energy of charged particles emitted within a range of azimuth $\phi$ at a specified polar angle $\theta$ is analyzed. The difference between the type 2 and the type 3 resides in that an angular range in a plane is measured in the type 2, whereas an angular range on the surface of a conical body is measured in the type 3. Thus, such three types of the angle-and-energy simultaneously measuring type energy analyzers are proposed, and some of them are being used. However, the conventional angle-and-energy simultaneously measuring type energy analyzers have the problems as described below.

Although the analyzer of the type 1 is one having the highest efficiency and therefore is preferably used, such analyzer which is now available is very complicated and expensive. Further, a measuring and controlling system used in association with the analyzer is also complicated and expensive.

There exist a few kinds of the analyzers of the type 2 which are basically capable of measuring only an angular distribution in a single and same plane.

The analyzer of the type 3 includes a CMA type energy analyzer (Cylindrical Mirror Analyzer). In this energy analyzer, the polar angle $\theta$ as shown in FIG. 2 is fixed to $\theta=42°\ 18.5'$. Although an energy analyzer in which the polar angle $\theta$ is changeable has been proposed, few such analyzers have been used because a range of changing the angle $\theta$ is narrow.

It is an object of the present invention to eliminate the above-mentioned problem and to provide charged particle energy analyzer capable of measuring the magnitude of the energy of the charged particles and the distribution in a range of angle of the charged particles simultaneously.

In accordance with the present invention, there is provided a charged particle energy analyzer of an electrostatic concentric spherical surface type or a coaxial cylindrical mirror type which analyzes the kinetic energy of charged particles emitted or scattered from a sample by irradiating an X-ray or particles to the sample characterized by comprising the sample and an outlet aperture arranged on the symmetric central axis passing through an electrostatic concentric spherical surface body or a coaxial cylindrical mirror body, an inlet port and an outlet port each having a circular-arc-like slit which has its center on the symmetric central axis, electrodes disposed at the slit of the inlet port to deflect the track of the charged particles and change the speed of the charged particles, and a position sensitive type detector disposed at the rear of the outlet aperture to detect the charged particles.

In accordance with the present invention, a moving means for moving the above-mentioned charged particle energy analyzer in parallel to the symmetric central axis is provided to the energy analyzer.

Further, the charged particle energy analyzer is provided with an electrode having a circular-arc-like slit whose center is on the symmetric central axis, between the outlet aperture and the position sensitive type detector so as to deflect and accelerate or decelerate the charged particles.

Figure 2B:
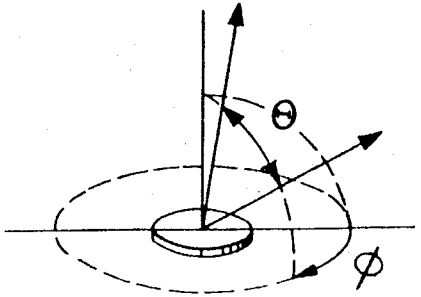
FIG. 2 is a diagram for illustrating three basic types in an angle-and-energy simultaneously measuring type charged particle energy analyzing method.
Figure 2C:
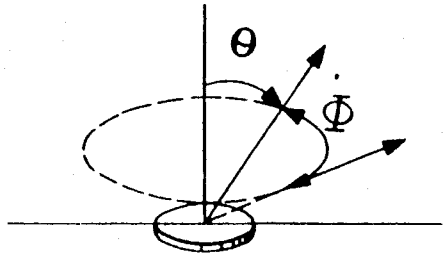
Figure 2A:
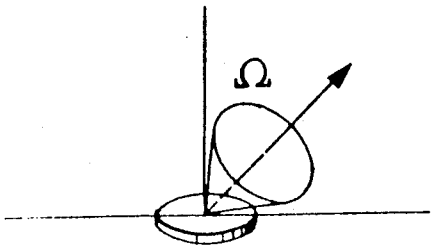

In the present invention, since means to change a positional relation with respect to the symmetric central axis of the energy analyzer to the sample is provided at the charge particle energy analyzer, the polar angle $\theta$ in the type 3 in FIG. 2 can be selected in addition to the capability of realizing the function of the type 3. Further, the energy analyzer possesses the function of the type 2.

Figure 1:
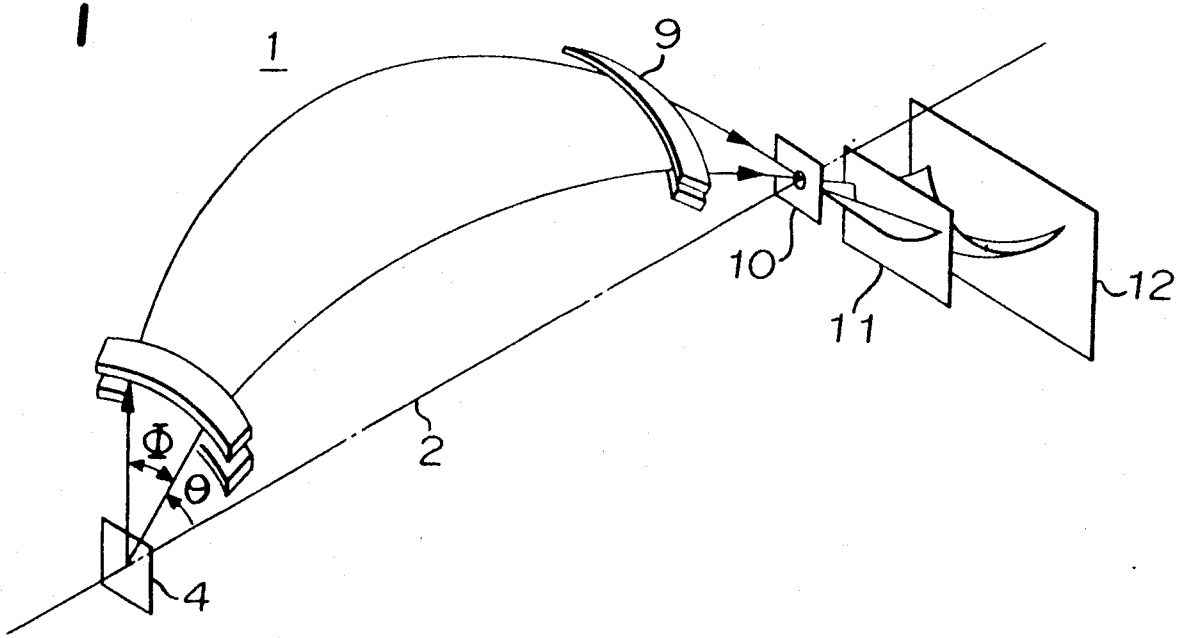
FIG. 1 is a diagram for illustrating the principle of the present invention.

FIG. 1 is a diagram for illustrating the principle of the operation of the analyzer of the present invention. Namely, the charged particles falling in a region defined by the range of an azimuth $\phi$ at a specified polar angle $\theta$ among the entire charged particles emitted or scattered from a small region of a sample 4 are taken in an inlet slit. The energy of the charged particles taken into the inlet slit is analyzed, and only the charged particles having a certain level of energy emit through an outlet slit 9 to be detected by a position sensitive type detector 12. The energy analyzer of the present invention has a symmetric body with respect to an axis of rotation 2 or a part thereof, and a sample 4 is placed as shown by (A) in FIG. 3 so that the symmetric central axis 2 coincides with the normal line to the sample. Accordingly, the charged particles falling in the range of an azimuth $\phi$ are uniformly analyzed to detect the energy and further, the direction of propagation of the charged particles emitting through the outlet slit depends on an azimuth when the charged particles are emitted or scattered from the sample. Accordingly, the azimuth of the charged particles having the same energy is determined in correspondence to positions of the position sensitive type detector.

Figure 4:
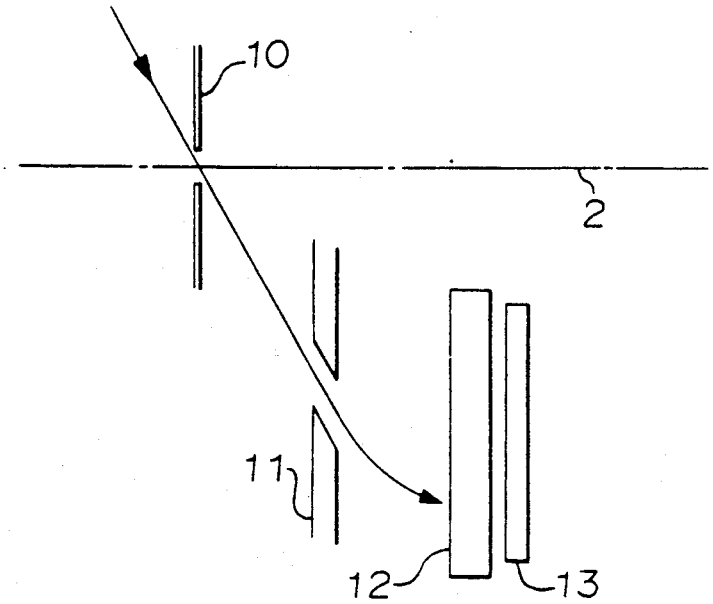
FIG. 4 is a diagram showing a positional relation among an outlet aperture, a deflection electrode and a position sensitive type detector.

The setting of the polar angle $\theta$ is conducted in such a manner that the energy analyzer or sample is moved in parallel to the symmetric central axis 2, and an appropriate amount of electrostatic voltage is applied to a deflection electrode disposed at the inlet slit. At the same time, a voltage for acceleration or deceleration which adjusts the energy of the charged particles entering in the inlet slit may be applied to the deflection electrode. Further, the electrode 11 having a circular-arc-like slit whose center is on the symmetric central axis is positioned on the track of the charged particles between the outlet aperture 10 and the position sensitive type detector 12 as shown in FIG. 4 so as to prevent the reduction of detecting efficiency of the position sensitive type detector 12 or to prevent secondary electrons from being mixed with.

Figure 3:
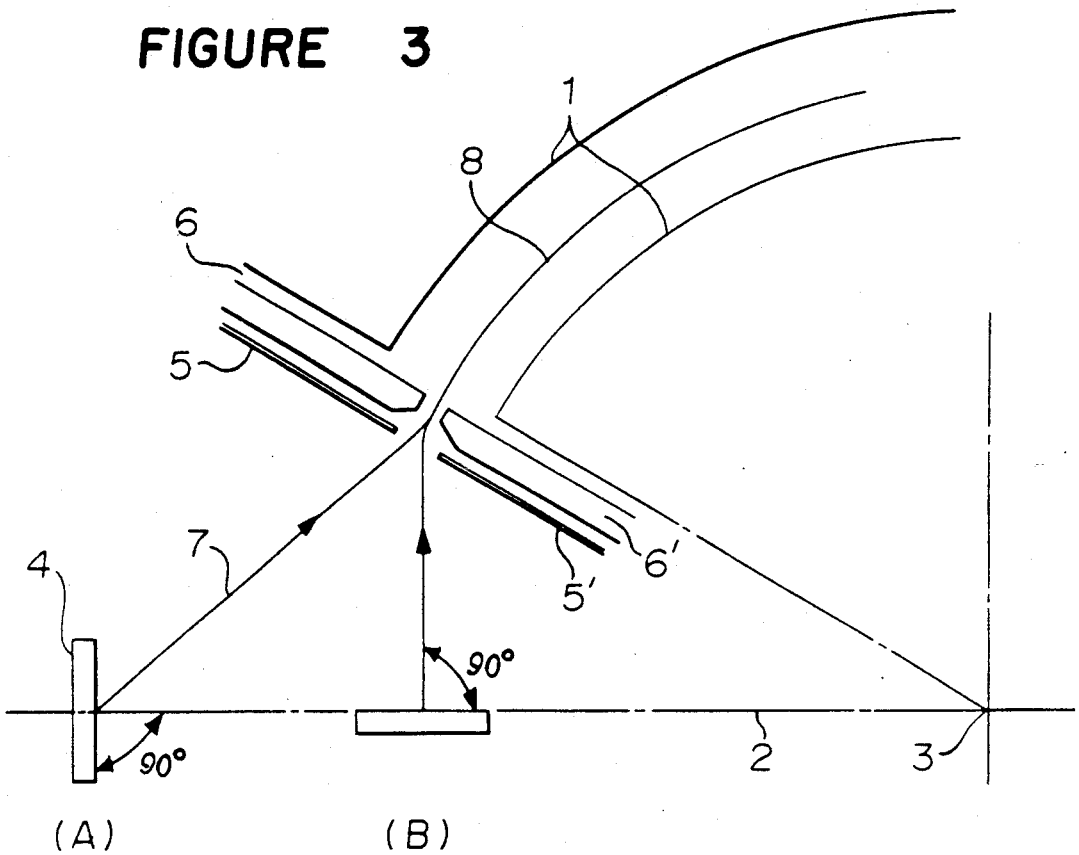
FIG. 3 is a diagram showing a positional relation of a sample to the angle-and-energy simultaneously measuring type charged particle energy analyzer used for the present invention.

The measurement by the type 2 in FIG. 2 by using the energy analyzer of the present invention is carried out in such a manner that a sample is positioned in parallel to the symmetric central axis as indicated by (B) in FIG. 3, and a positional relation of the sample to the energy analyzer with respect to the symmetric central axis 2 and a static electric voltage to be applied to a deflection electrode disposed at the inlet slit are properly determined.

A preferred embodiment of the present invention will be described with reference to the drawings.

Figure 5:
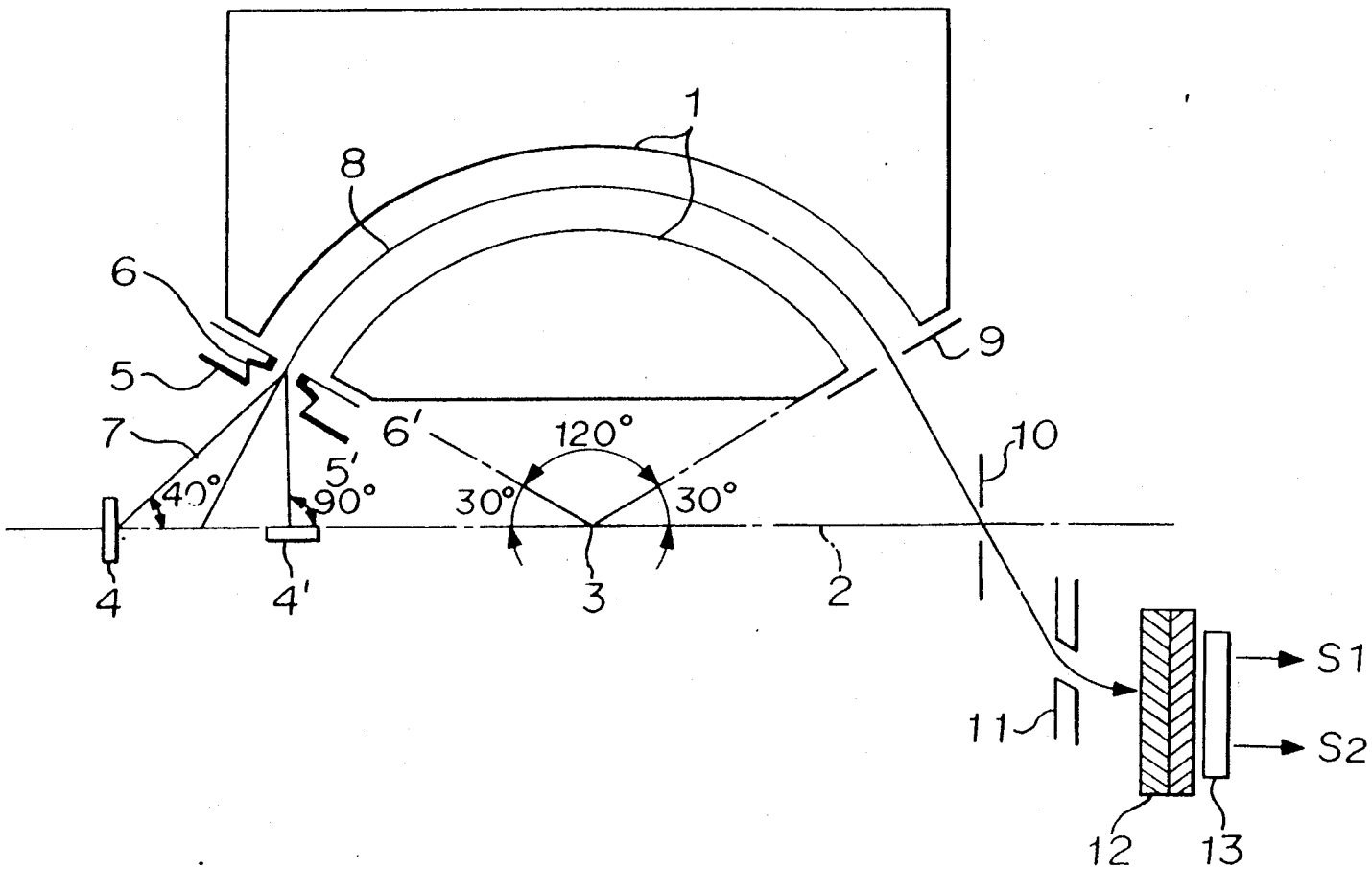
FIG. 5 is a diagram of an embodiment of the charged particle energy analyzer according to the present invention.

FIG. 5 is a diagram of an embodiment of the energy analyzer according to the present invention.

In FIG. 5, a reference numeral 1 designates a 120° electrostatic concentric spherical surface type energy analyzer having inner and outer spherical surfaces whose radii are respectively 45 mm and 55 mm, and a numeral 2 designates a symmetric central axis passing through the center 3 of the spherical surfaces. A sample to be measured 4 is positioned so that the symmetric central axis 2 coincides with the normal line of the sample. Electrodes 5, 5', 6, 6' are respectively disposed at a circular-arc-like inlet slit having its center on the symmetric central axis. In FIG. 5, thick lines indicate electrode surfaces of the electrodes. The potential at the electrodes 5, 5' is the same as that of the sample 4. The electrode 6 is applied with a voltage of up to about 40% as large as that of the difference between a voltage at the outer spherical surface of the energy analyzer 1 and a potential at the central track of the charged particle track 8. The electrode 6' is supplied with a voltage of up to about 40% as large as that of the difference between a voltage at the inner spherical surface of the energy analyzer 1 and a potential at the central track of the charged particle track 8. The charged particles emitted from the sample 4 along the track 7 are deflected in a plane including the track 7 and the symmetric central axis 2 by the action of the electrodes 5, 5', 6, 6' to thereby enter in the track 8. Namely, the polar angle $\theta$ for the measurement is determined depending on the position of the sample 4 on the symmetric central axis 2, and it is enough to determine a d.c. voltage to be applied to the electrodes 5, 5', 6, 6' so that the charged particles emitted from the sample 4 at a polar angle $\theta$ are emitted perpendicularly through the plane of the inlet slit and that they enter into the track 8. In this embodiment of the present invention, design is so made that the measuring range of azimuth $\phi$ is 75° and the range of the polar angle $\theta$ which is adjustable is 40°-90° although the measuring ranges of the azimuth $\Phi$ to be measured and the range of the polar angle $\theta$ to be adjustable depend on the shapes of the electrodes 5, 5', 6, 6'. The measurement of the type 2 in FIG. 2 is possible when the sample is so positioned that the surface of the sample is in parallel to the symmetric central axis 2 at a position of $\theta=90°$, namely, the sample is set at a position 4' in FIG. 5. In this case, the measuring range of the polar angle is 75°.

In FIG. 5, a reference numeral 9 designates a circular-arc-like outlet slit having its center on the symmetric central axis 2, and a numeral 10 designates an outlet aperture positioned on the symmetric central axis 2. Each potential at the outlet slit 9 and the outlet aperture 10 is the same as that of the central track of the charged particle track 8. Among the charged particles dispersed in the electrostatic concentric spherical surface type energy analyzer 1, only charged particles having a specified energy level pass the outlet slit 9 and the outlet aperture 10 so that a uniform energy level is produced. A deflection electrode 11 has also a circular-arc-like slit whose center is on the symmetric central axis 2. A position sensitive type detector 12 comprises two microchannel plates (MCP) having an effective diameter of about 25 mm. The potential of the deflection electrode 11 is the same as that of the outlet aperture 10. An acceleration or deceleration voltage can be applied across the position sensitive type detector 12 and the deflection electrode 11. When an acceleration voltage is applied, the charged particles enter into the position sensitive type detector 12 at a nearly right angle, whereby the detecting efficiency of the detector can be increased. On the other hand, when a deceleration voltage is applied, the entering of scattered secondary electrons into the position sensitive type detector through the outlet aperture 10 can be prevented.

The charged particles are transduced into electrons and amplified to $10^7$-$10^8$ times by the position sensitive type detector 12, whereby a multianode 13 is excited The multianode 13 comprises 30 electrodes radially arranged wherein each of the electrodes corresponds to an azimuth of 2.5°. Each of the 30 electrodes is connected with an preamplifier and a pulse peak discriminator so that the intensity of the charged particles at angular intervals of 2.5° is simultaneously measured.

EXAMPLES

Experiments were conducted to confirm the function of the angle-and-energy simultaneously measuring type charged particle energy analyzer of the present invention which has been described above. The charged particle energy analyzer as shown in FIG. 5 was used, and a Si (1 1 1) wafer was used as a sample 4. The energy analyzer as shown in FIG. 5 was placed in a ultravacuum chamber and the chamber was evacuated to have a pressure of $3\times10^{-10}$ Torr. The Vacuum chamber is connected to the electron lens assembly of a scanning electron microscope capable of irradiating the surface of the sample (on the right side in FIG. 5) from the direction of substantially perpendicular to the paper surface of FIG. 5 by electron beams having a power of 6 KV-1 nA and a beam diameter of about 100 Å. After the Si sample was cleaned by heating in vacuum, it was confirmed by a reflection high energy electron diffraction method in which electron beams are used that the surface of the sample showed a surface super-structure of $7\times7$.

By radiating the electron beams, Auger electrons, inelastic secondary electrons and so on are emitted from the surface of the sample. Of these electrons, Si KLL Auger electrons (having a kinetic energy of 1,613 eV) are analyzed by the charged particle energy analyzer.

Figure 6:
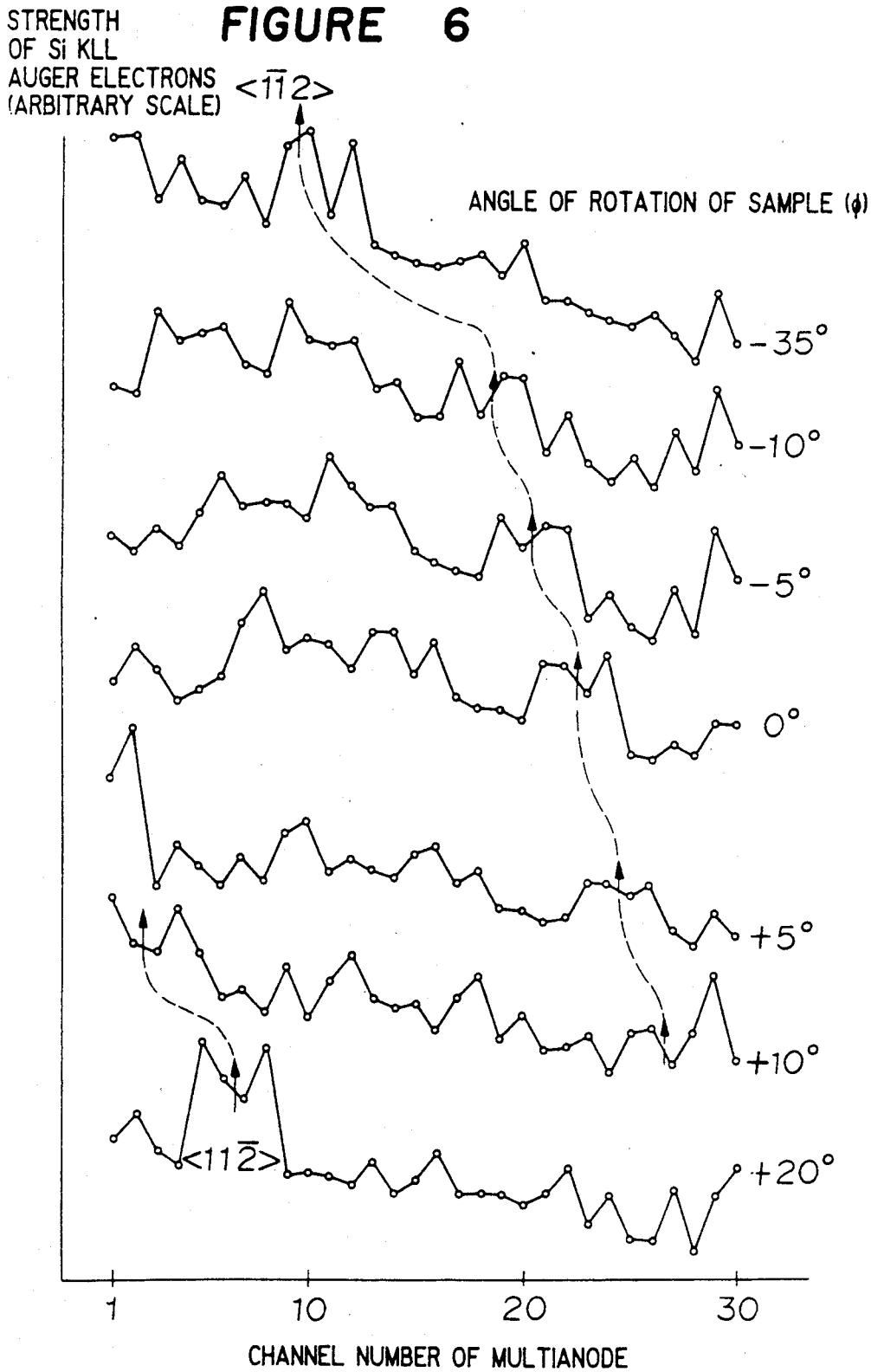
FIGS. 6 and 7 are respectively diagrams showing a result obtained by the measurement of the surface of a Si (1 1 1) 7×7 wafer by the angle-and-energy simultaneously measuring type charged particle energy analyzer of the present invention.

FIG. 6 shows a result of the analysis wherein the abscissa represents the channel number of 30 electrodes of the multianode, and the intensity of the KLL Auger electrons at each of the channels are plotted in the ordinate. The angle of rotation of the sample in the graph is obtained by rotating around the central axis 2 the sample placed at the position of 4 in FIG. 5. In this case, no potential difference is given across the deflection electrodes 6, 6'. The structure shown in the graph reflects anisotropy of the KLL Auger electrons emitted from the Si (1 1 1) $7\times7$ surface. It is, in fact, found that each of folded lines in the graph extends in the right and left directions as the sample is rotated. Arrow marks in FIG. 6 indicate the direction of the symmetric axis in the Si (1 1 1) surface. In view of the traces of the arrow marks, it is understood that the angle for each channel of the multianode is 2.5°.

Figure 7:
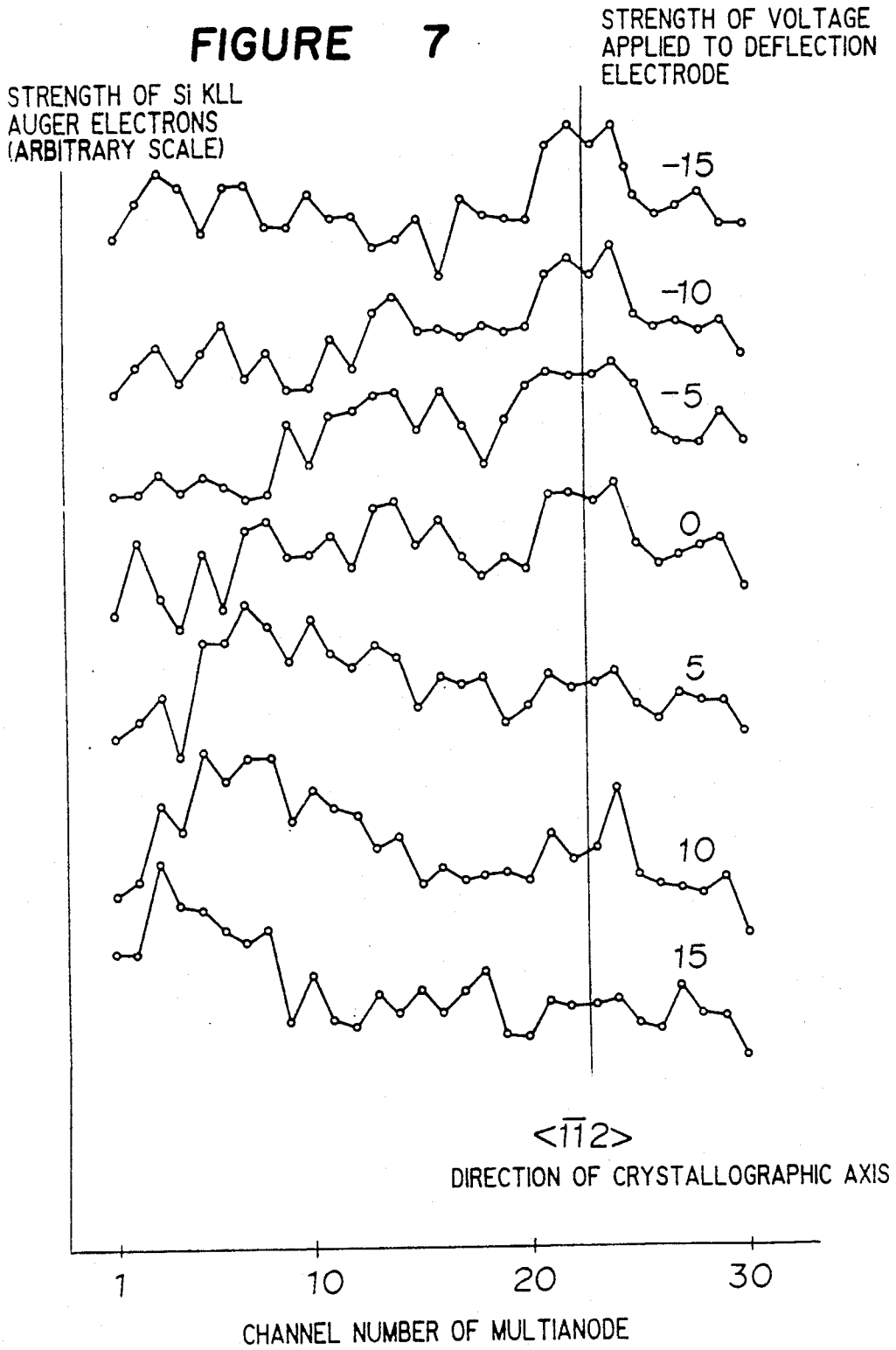

FIG. 7 is a graph showing the effect of the deflection electrode at the position of an angle of rotation $\phi=0°$ of the sample in FIG. 6. Each numerical value which express the strength of a voltage at the deflection electrode means what percents of the voltage to the spherical surface electrode 1 is applied to the deflection electrodes 6, 6' wherein positive symbols represent that a voltage is applied across the electrodes 6, 6' in the forward direction to the spherical surface electrode, and negative symbols represent that a voltage is applied thereto in the opposite direction. In view of FIG. 7, it is understood that an anisotropic pattern of the strength of KLL Auger electrons is changed as the voltage applied to the deflection electrodes is changed. This change of the anisotropic pattern shows a change depending on the change of the polar angle in the detection of Auger electrons from the surface of the sample in FIG. 5. The determination of correct polar angle for the detection of the Auger electrons is not made in the above-mentioned embodiment.

Description has been made as to a case of using the electrostatic concentric spherical surface type energy analyzer. However, the same function as the angle-and-energy simultaneously measuring type energy analyzer can be provided to a coaxial cylindrical mirror type energy analyzer. In this specific case, the entire construction of the latter is the same except that the shape of the electrodes and a voltage applied to the electrodes positioned at the inlet slit are changed.

As described above, use of the angle-and-energy simultaneously measuring type charged particle energy analyzer of the present invention provides the advantages as follows.

(1) Efficiency in measuring charged particles emitted within a certain range of angle can be increased about several ten times—about a hundred times, whereby a time of measurement can be shortened. Accordingly, it is possible to minimize influence by the contamination of the surface of a sample with a lapse of time.

(2) Since it is unnecessary to move the measuring device to measure charged particles with angle dependence, the vibrations of the device can be eliminated. Accordingly, the measurement to a very small region (several 100–several 1,000 Å) can be done.

(3) The energy analyzer and a moving mechanism can be installed at a vacuum flange such as a conflat flange having a diameter of 203 mm, and it is unnecessary to use a complicated rotating device. Accordingly, the entire size of the device can be small. The energy anaylzer can be used in various fields. Further, handling operations can be easy.

(4) It is sufficient to use a one dimensional positional sensitive sensing circuit as a measuring circuit system. The circuit system is inexpensive and provides simple data processing.

What is claimed is:

1. A charged particle energy analyzer of an electrostatic concentric spherical surface type or a coaxial cylindrical mirror type which analyzes the kinetic energy of charged particles emitted or scattered from a sample by irradiating an X-ray or particles to the sample characterized by comprising:

said sample and an outlet aperture arranged on the symmetric central axis passing through the center of an electrostatic concentric spherical surface body or a coaxial cylindrical mirror body, an inlet port and an outlet port each having a circular-arc-like slit which has its center on the symmetric center axis, electrodes disposed at the slit of the inlet port to bend the track of the charged particles from the sample and entering the analyzer and change the speed of the charged particles, and a position sensitive type detector disposed at the rear of the outlet aperture to detect the charged particles.

2. The charged particle energy analyzer according to claim 1, which further comprises a moving means to move the entirety of the energy analyzer in parallel to the symmetric central axis.

3. The charged particle energy analyzer according to claim 1 or 2, wherein an electrode having a circular-arc-like slit whose center is on the symmetric central axis is provided between the outlet aperture and the position sensitive type detector so as to deflect and accelerate or decelerate the charged particles.

* * * * *